US007179077B2

(12) United States Patent
Chennells

(10) Patent No.: US 7,179,077 B2
(45) Date of Patent: Feb. 20, 2007

(54) CONCRETE BLOCK PRESS

(75) Inventor: Donald P. Chennells, 211 Margate Road, Winnipeg, Manitoba (CA) R2P 1A9

(73) Assignees: Donald P. Chennells (CA), part interest; Amanda Bond (CA), part interest ( * ) Notice: Subject to any disclaimer, the term of this patent is extended or adjusted under 35 U.S.C. 154(b) by 135 days.

(21) Appl. No.: 10/906,394

(22) Filed: Feb. 17, 2005

(65) Prior Publication Data

US 2006/0182839 A1 Aug. 17, 2006

(51) Int. Cl.
*B28B 3/04* (2006.01)
*B28B 1/08* (2006.01)

(52) U.S. Cl. ..... 425/255; 425/260; 425/421; 425/422; 425/432

(58) Field of Classification Search ..... 425/255, 425/260, 421, 422, 432
See application file for complete search history.

(56) References Cited

U.S. PATENT DOCUMENTS 2,308,132 A * 1/1943 Wellnitz ..... 425/422
2,341,012 A * 2/1944 Billman et al. ..... 425/422
2,494,212 A * 1/1950 Spriggs et al. ..... 425/255
2,512,092 A * 6/1950 Dike et al. ..... 425/255
2,593,409 A * 4/1952 Brown, Jr. ..... 425/260
2,670,516 A * 3/1954 McEachran ..... 425/421
2,888,731 A * 6/1959 McElroy et al. ..... 425/421
3,781,156 A * 12/1973 Moore ..... 425/424
4,063,866 A 12/1977 Lurbiecki
4,098,562 A 7/1978 Levin
4,111,627 A * 9/1978 Kitahara ..... 425/421
4,193,754 A * 3/1980 Sekiguchi ..... 425/422
4,836,762 A 6/1989 Davis, Jr.
4,869,660 A 9/1989 Ruckstuhl
4,944,907 A 7/1990 Davis, Jr.
6,499,985 B1 12/2002 Sekiguchi et al.

* cited by examiner

*Primary Examiner*—James P. Mackey
(74) *Attorney, Agent, or Firm*—Vermette & Co.

(57) ABSTRACT

A concrete block-molding machine having a concrete mix feed station, and a concrete molding and block ejection station adjacent to the feed station wherein the concrete molding and block ejection station has a vibratile plate having a plurality of holes in a pre-selected hole pattern, a mold having a mold interior positionable on the vibratile plate and having holes in the pre-selected hole pattern, and a support plate dimensioned and patterned to form a bottom face of a molded concrete block. An ejector plate having a plurality of projecting rods in the pre-selected hole pattern is positionable below the vibrating plate, with the rods of a diameter such that they pass through the holes in the vibratile plate and the mold. Means are provided for raising and lowering a pressure plate assembly so as to compress a concrete mix in the mold provided. Means are also provided for raising and lowering the ejector plate so as to contact and raise and lower the support plate out of and into the mold.

7 Claims, 4 Drawing Sheets

CONCRETE BLOCK PRESS

FIELD

The present invention relates to a concrete block press used to manufacture concrete blocks.

BACKGROUND

Concrete blocks have been commonly used in construction for many decades. However, since the 1980's several companies have looked for systems, which could be assembled more rapidly. A dry stack system was introduced in order to reduce skilled labour requirements, permit faster stacking and eliminate wet material. Initially dry stack systems suffered from quality control. Variations in height dimensions of 1/16 inch caused deviations from plumb after just three or four courses and required shims to adjust the height. However, while still suffering from some height variation, dry stack systems have since improved and are now competitive in many more market segments than before.

Machines to manufacture concrete blocks provide for a hopper to temporarily hold the mixed concrete until it can be poured into a mold. Many different cast moldings are known but generally the negative shape of the finished block is formed on the inside of the mold. The mold is placed on a support board and then pushed onto a vibrating table where it is filled with concrete from the hopper. As soon as the mold is filled with concrete, a pressure plate descends upon the concrete in the mold. Either concurrently with vibrating the vibrating table or after, pressure is applied to the fresh concrete in the mold by depressing the pressure plate. The pressure plate is raised vertically and then the support plate is raised with the finished pre-cast brick remaining on the support board. The support board and brick are carried away by a board carriage for onward transportation by a conveyor system. A new support board is then pushed into the mold, which rests on the vibrator plate. Generally, such manufacturing systems include a turntable with several work stations as well as the concrete block molding machine. Such systems are large, relatively expensive and difficult to move.

Accordingly, it is an object of the invention to provide a compact mold-making machine that is easily moved and which produces concrete blocks of precise accuracy.

SUMMARY OF THE INVENTION

According to the invention, there is provided a concrete block-molding machine having a concrete mix feed station, and a concrete molding and block ejection station adjacent to the feed station wherein the concrete molding and block ejection station has a vibratile plate having a plurality of holes in a pre-selected hole pattern, a mold having a mold interior positionable on the vibratile plate and having holes in the pre-selected hole pattern, and a support plate dimensioned and patterned to form a bottom face of a molded concrete block. An ejector plate having a plurality of projecting rods in the pre-selected hole pattern is positionable below the vibrating plate, with the rods of a diameter such that they pass through the holes in the vibratile plate and the mold. Means are provided for raising and lowering a pressure plate assembly so as to compress a concrete mix in the mold provided. Means are also provided for raising and lowering the ejector plate so as to contact and raise and lower the support plate out of and into the mold.

BRIEF DESCRIPTION OF THE DRAWINGS

Further features and advantages will be apparent from the following detailed description, given by way of example, of a preferred embodiment taken in conjunction with the accompanying drawings, wherein.

DETAILED DESCRIPTION WITH REFERENCE TO THE DRAWINGS

Figure 1:
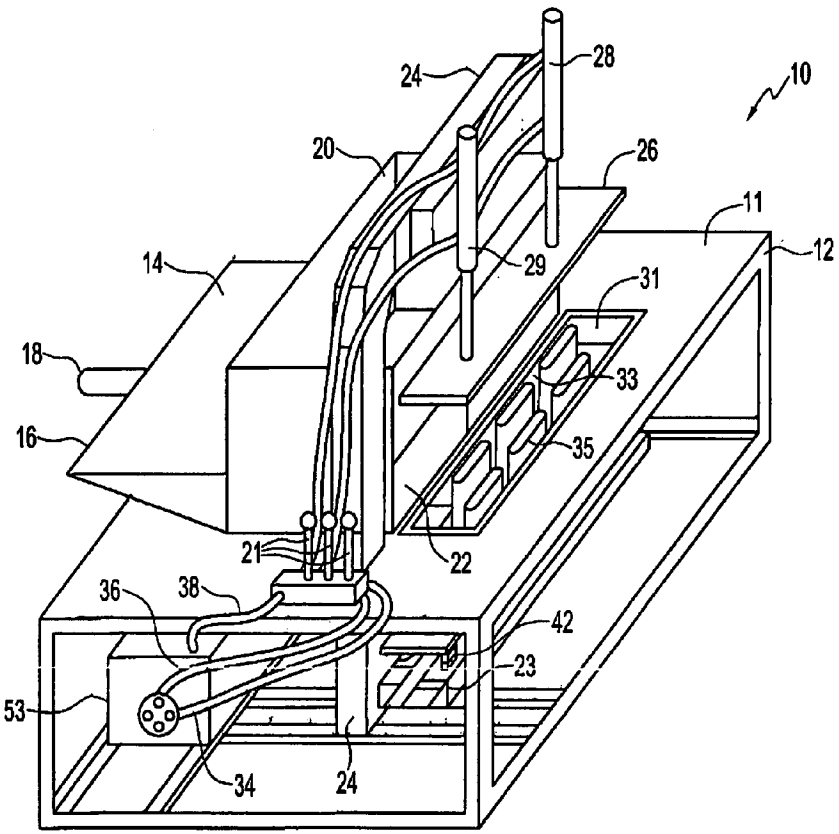
FIG. 1 is a perspective view of the concrete block mold machine.

The concrete block mold machine 10 as shown in FIG. 1, consists of a large box-like frame 12 having an open interior. On the top surface of the frame 12 there is mounted a hopper 20 and a concrete pusher and hopper block 16. Adjacent the hopper 20 is a molding station 31. A mold interior surface 33 is visible with two rows of three projections 35 that are used to form openings 43 in the molded concrete block 30.

A large arm 24 passes through the top of frame 12 and is supported by the bottom thereof. Attached to the arm 24 are two spaced apart piston-cylinder units 28 and 29 having piston arms to the end of which is attached a pressure plate 26. Hydraulic hoses 34, and 36 coming from hydraulic pump 59 and return line 38 feed hydraulic fluid to the piston cylinders 28 and 29. Switches coupled to control handles 21 control the lines.

Figure 2:
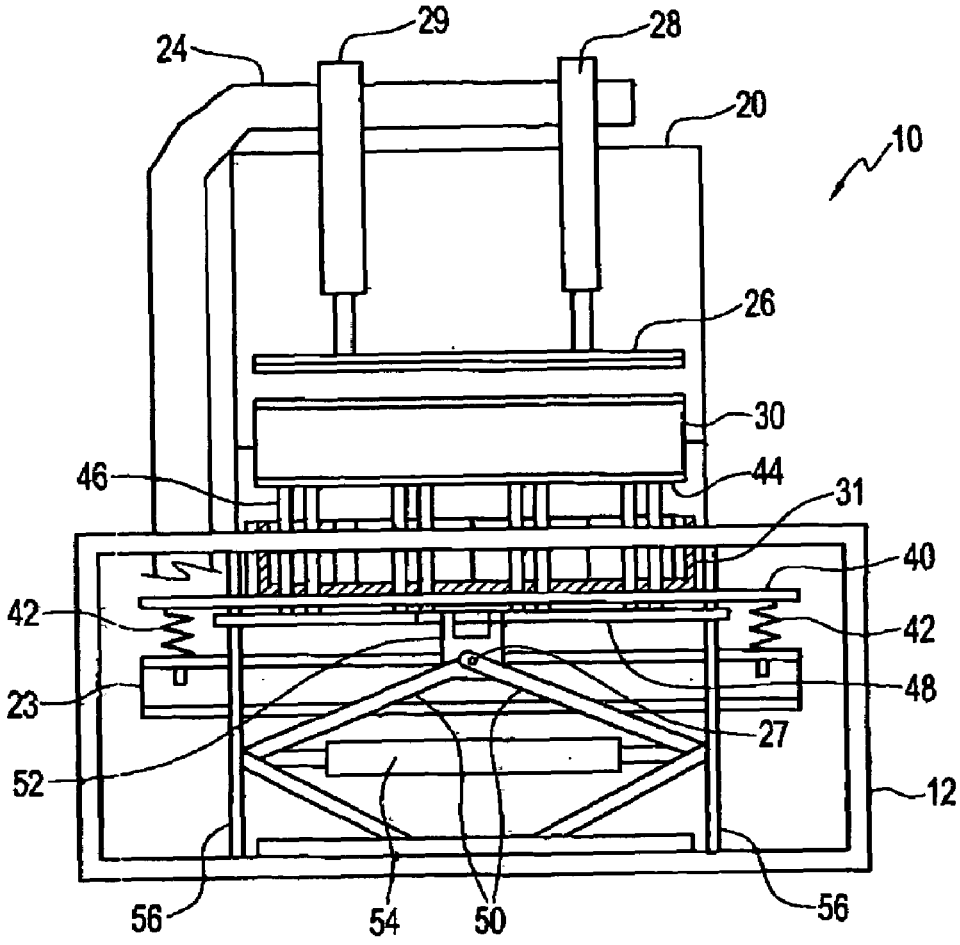
FIG. 2 is front elevation view of the concrete block mold machine.

Referring to FIG. 2, a vibrating plate 40 is suspended atop four springs 42 mounted on U-channels 23. The U-channels 23 are mounted to arm 24, which extends down through the deck 11 to the bottom of frame 12 on both sides thereof. Vibrating plate 40 has a plurality of holes over its surface patterned to coincide with projections 46 projecting up from a support plate ejector plate 48. Ejector plate 48 has openings, which slide up and down guide rods 56. To the sides of the ejector plate 48 are affixed two clamps 52, with the bottoms of the clamps being coupled to shaft 27. Shaft 27 passes through a top of scissor truss arms 50. Truss arms 50 pass through two other shafts (not shown), which connect to the hydraulic piston arms of hydraulic piston cylinder 54. Withdrawal of the piston arms cause the scissor truss arms 50 to be raised and extension of the piston arms cause the scissor truss arms 50 to be lowered, thereby raising and lowering ejector plate 48, respectively.

Figure 3:
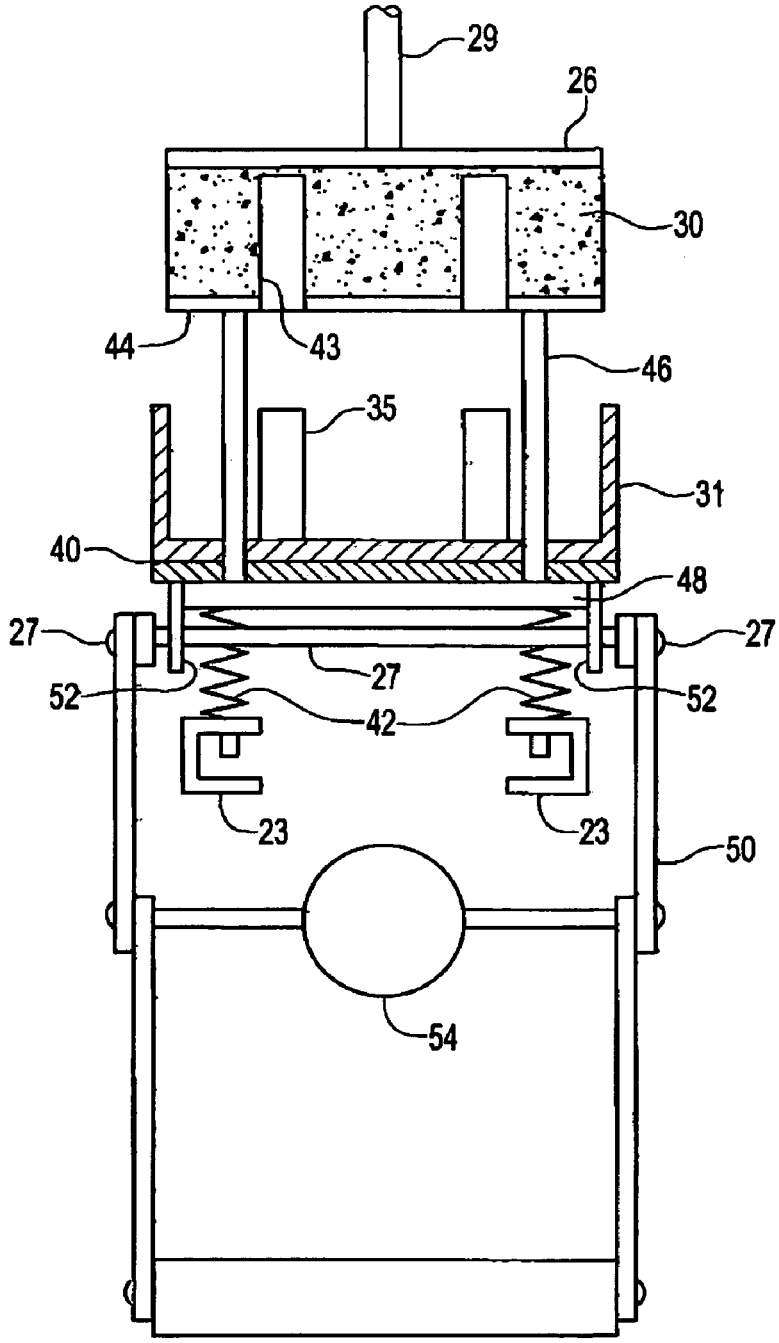
FIG. 3 is a top view of the concrete block mold machine.
Figure 4:
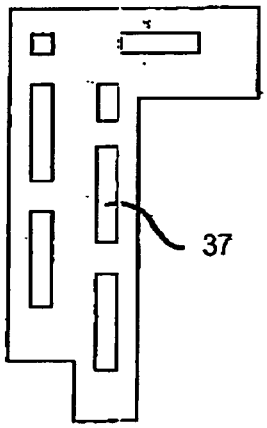
FIG. 4 is a plan view of a left corner support plate.
Figure 5:
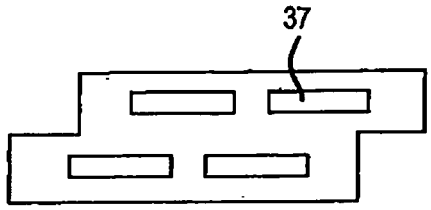
FIG. 5 is a plan view of a long running support plate.
Figure 7:
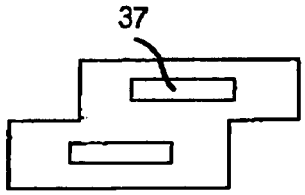
FIG. 7 is a plan view of a short running support plate.
Figure 6:
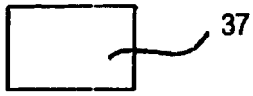
FIG. 6 is an end view of the support plate of FIG. 5.
Figure 8:
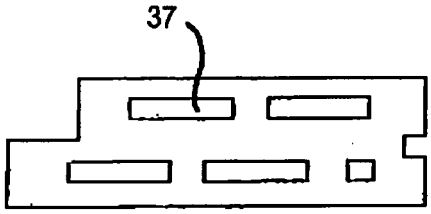
FIG. 8 is a plan view of a long jamb support plate.
Figure 9:
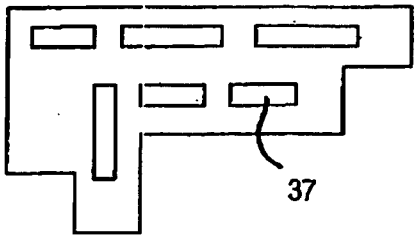
FIG. 9 is a plan view of a right corner support plate.
Figure 10:
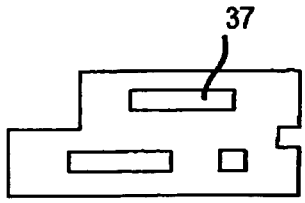
FIG. 10 is a plan view of a short jamb support plate.

Referring to FIG. 3, ejector plate 48 has a plurality of upwardly directed rods 46 patterned to pass through corresponding holes in the vibrating plate 40 and the mold 31. Ejector plate 48 is affixed to the scissor truss arms 50 by two brackets 52 journaled to elongated pin 27. Elongated pin 27 couples an upper end of each of the two pairs of scissor truss arms 50 together. In its lowermost position, in which hydraulic piston-cylinder 54 is fully extended, the ejector plate 48 is in its lowermost position in which rods 46 are fully withdrawn from mold 31 and vibrating plate 40 and support plate 44 rests on the bottom of mold 31. As hydraulic piston-cylinder 54 retracts, scissor truss arms 50 raise up ejector plate 48 with rods 46 passing through the holes in the vibrating plate 40 and the mold 31 until they contact an underside of support plate 44. Support plate 44 is raised out of mold 31 until it reaches the position shown in FIG. 3.

Various designs of molds 31 and corresponding support plates 44 are possible as seen by the support plate designs in FIGS. 4–10. Each design has rows of elongated slots 37. Typical dimensions of a block are 6 inches thick by 8 inches wide by 24 inches long. The corresponding support plates 44 have hole patterns and edge patterns, which match those of the desired block design.

In operation, the desired mold 31 and support plate 44 are put in place atop vibrating plate 40 depending on the design of the block desired. A charge of pre-mixed concrete is then poured into hopper 20 and pusher and hopper block 16 is manually pushed forward causing the concrete charge to be advanced and to drop into mold opening 31 and mold interior 33. Ejector plate 48 is in its lowermost position. Any excess concrete is captured atop a blocking plate 14. Consequently, a precise amount of concrete is contained in each charge advanced to the mold 31. The hydraulic cylinders 28 and 29 are extended causing pressure plate 26 to lower and compress the concrete block 30. Simultaneously, the vibrating plate 40 is caused to vibrate by operation of a motor and cam contacting plate 40 (not shown). Projections 35 create holes 43 in a desired hole pattern in the concrete block 30. Once compressed by pressure plate 26 and the vibrating plate 40, the pressure plate 26 is raised then the ejector plate 48 is raised until it contacts the support plate 44. The block 30 and support plate 44 are raised above the top of frame 12. Block 30 and support plate 44 are removed by a small forklift (not shown) that carries the block to a drying rack (not shown). A new support plate 44 is inserted into the mold and the process is repeated for a next block.

The relatively small, self-contained concrete block mold machine 10 means it can be easily transported and put into operation. The precise amount of concrete being placed in the mold allows more efficient operation with less waste. The fact that the concrete 30 is raised out of the mold 33 and is removed immediately after pressurizing with the pressure plate 26 avoids any problems of expansion of the curing mix of concrete 30. As compared to most block fabricating plants the present block molding machine 10 does not require an expensive multi-station fabricating assembly. Operation can be set up inexpensively in relatively small quarters.

It will be obvious to those skilled in the art that one could make more than one mold opening 31 and mold 33.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description.

What is claimed is:

1. A machine for making a concrete block, comprising:

(a) a hopper operative to receive and hold a pre-determined amount of pre-mixed concrete;

(b) a mold having a mold cavity proximate to said hopper;

(c) a mold charge transporter operative to move a mold charge of said pre-mixed concrete in said hopper to said mold cavity;

(d) a support plate positioned at a bottom of said mold cavity;

(e) a vibratile plate positioned beneath said mold and supported by a plurality of springs, operative to vibrate in response to a user applied control signal, said vibratile plate having an array of holes over its surface;

(f) a pressure plate located above said mold and moveable from a retracted position to an extended position in which it contacts and applies pressure to the pre-mixed concrete in said mold; and (g) an ejector plate having a plurality of upright projections extending outwardly from its mold facing surface and positioned when raised to pass through the holes in said vibratile plate and contact and lift said support plate and the concrete above said mold.

2. A machine for making a concrete block, comprising:

(a) a mold having a mold cavity;

(b) means for receiving pre-mixed concrete and for transferring a predetermined amount of the concrete to said mold;

(c) a support plate positioned at a bottom of said mold cavity;

(d) a vibratile plate positioned beneath said mold, operative to vibrate and compress the concrete in said mold, said plate vibratile having an array of holes over its surface;

(e) a pressure plate located above said mold and moveable from a retracted position to an extended position in which it contacts and applies pressure to the pre-mixed concrete in said mold; and (f) an ejector plate having a plurality of upright projections extending outwardly from its mold facing surface and positioned, when raised, to pass through the holes in said vibratile plate and contact and lift said support plate and the concrete above said mold.

3. The machine according to claim 2, wherein said means for receiving and transferring is a hopper operative to receive and hold a pre-determined amount of pre-mixed concrete and a mold charge transporter operative to move a mold charge of said pre-mixed concrete in said hopper to said mold cavity.

4. The machine according to claim 2, wherein said pressure plate is supported by two spaced apart hydraulic piston cylinders.

5. The machine according to claim 3, wherein said hopper is supported on an elevated deck of a frame and said mold charge transporter includes an open box at a bottom of said hopper slidable to push a charge of concrete towards said mold.

6. The machine according to claim 5, wherein the ejector plate is supported by hydraulically controlled scissor members mounted to a bottom of said frame.

7. The machine according to claim 2, wherein the support plate fits into a bottom of said mold with projections from said bottom passing through openings in said support plate.

* * * * *